United States Patent [19]

Elko et al.

[11] 4,455,791

[45] Jun. 26, 1984

[54] PROTECTIVE COVER FOR GUTTERS

[76] Inventors: George A. Elko, 19800 Woodpecker Rd., Petersburg, Va. 23803; Charles B. O'Brien, 1308 Elmwood Dr., Colonial Heights, Va. 23834

[21] Appl. No.: 386,988

[22] Filed: Jun. 10, 1982

Related U.S. Application Data

[63] Continuation-in-part of Ser. No. 272,209, Jun. 10, 1981, abandoned.

[51] Int. Cl.[2] ..... E04D 13/04

[52] U.S. Cl. ..... 52/12

[58] Field of Search ..... 52/12, 11

[56] References Cited

U.S. PATENT DOCUMENTS

| | | | |
|---|---|---|---|
| 546,042 | 9/1895 | Van Horn | 52/12 |
| 836,012 | 11/1906 | Cassen . | |
| 891,405 | 6/1908 | Cassens . | |
| 2,365,845 | 12/1944 | Schweda | 52/12 |
| 2,636,458 | 4/1953 | Harris | 52/12 X |
| 2,669,950 | 2/1954 | Bartholomew . | |
| 2,672,832 | 3/1954 | Goetz | 52/12 |
| 3,023,544 | 3/1962 | Hughes | 52/12 |
| 3,351,206 | 11/1967 | Wennerstrom | 52/12 X |
| 3,388,555 | 6/1968 | Foster . | |
| 4,199,121 | 4/1980 | Le Febure | 52/12 X |
| 4,309,792 | 1/1982 | Faye | 52/12 X |

*Primary Examiner*—John E. Murtagh

*Attorney, Agent, or Firm*—Kenyon & Kenyon

[57] ABSTRACT

A protective structure for a gutter includes an elongated, impervious sheet wide enough to extend across at least about 90% of the width of the gutter and up under a lower edge of roofing material. The outer edge of the cover curls downwardly and the water follows the curvature by surface tension to cascade into the gutter. The cover may be held in place by straps that extend transversely across it and have one end engaged under the inwardly turned lip of the gutter and the other end engaged under the roofing material. Alternatively, clips may connect the curl to the inwardly turned lip of the gutter. Flanges extending downwardly from the ends of the gutter block off openings there.

15 Claims, 7 Drawing Figures

PROTECTIVE COVER FOR GUTTERS

This is a continuation in part of our co-pending application Ser. No. 272,209, filed June 10, 1981, now abandoned.

BACKGROUND OF THE INVENTION

1. Field of the Invention

This invention relates to the field of protective devices to prevent debris from entering a gutter on a house or other building. In particular, it relates to a protective cover in the form of a generally flat, impervious sheet that extends outwardly and downwardly from under a row of shingles or other roofing material to a point almost at the outer edge of the gutter. The outer edge of the sheet is curled under and either rests on spikes that attach the gutter to the building or is attached to the outer edge of the gutter. The cover is held in place by spaced members, either in the form of straps that extend from under the same roofing material, then over the cover and under the inwardly turned lip of the gutter, or in the form of clips that engage the inwardly turned lip and the curled edge. The part of each member adjacent the curled edge of the cover is bent to engage that edge to maintain a desired small space between the curled edge and the outer wall of the gutter so that water, even water resulting from a downpour, will be able to follow the curl by surface tension and cascade into the gutter.

2. Prior Art

The nuisance of having leaves, twigs and other debris get caught in a gutter is well-known to houseowners. It is common for such debris to form one or more dams along the length of a gutter and thus cause water to overflow during heavy rainfalls instead of being constrained within the gutter and flowing into the downspout. Such overflowing water is likely to wash away dirt immediately below the gutter and may also damage shrubs and plants located there. Even more objectionable is the fact that such overflowing water can work its way into the building and do substantial damage inside the structure. At the very least it produces much the same effect as if the building did not have a gutter.

In addition to accumulating in clumps in the gutter itself, the debris can also be carried to the downspout and can completely stop it up, which not only produces the same effect as if the gutter were dammed but can cause the build-up of enough weight of water or debris to break the supports of the downspout. The water, whether held back by dams in the gutter or in the downspout, can also place enough stress on the spikes that commonly hold the gutter in place to pull the gutter partly or entirely away from the building.

In order to avoid such undesirable effects, various forms of protective devices have been used. Since a heavy rainfall is commonly thought to require a large open space at the top of the gutter, a common protective device is a length of screen material attached to the edge of the roof or to the gutter or both to cover the entire gutter so as to prevent any debris from getting into the gutter. However, such screens can become clogged, thereby simply furnishing a solid surface across which the debris will flow to exactly the same point as if the gutter itself had overflowed. Another disadvantage is that the holes in the screen may be large enough to allow small twigs and other debris to enter the gutter and eventually to accumulate to the point where the gutter or the downspout or both become clogged. And the screen can be dislodged too easily.

Various forms of impervious sheets have also been used to prevent debris from entering a gutter. Such sheets have sometimes been formed as part of the gutter or formed in such a way as to extend over substantially the entire width of the gutter but provided with a curled edge around which water will flow by surface tension into the gutter. Such structures are shown in U.S. Pat. Nos. 546,042; 836,012; 891,405; 2,672,832 and 3,388,555. However, each of the gutter covers in those patents has a configuration that causes a problem.

The cover described by Van Horn in U.S. Pat. No. 546,042 extends to the outer edge of a wooden gutter and is held in place simply by corrugations that give it rigidity and that simultaneously form pathways along which water can flow into the gutter. No means are provided to maintain a uniform space between the entire outer edge of the cover and the outer edge of the gutter.

U.S. Pat. No. 836,012 to Cassen shows a separate piece of material that covers the gutter and is attached to the fascia of the house along one edge while the other edge is curled downwardly and is held in place by two straps, one of which extends under the cover and across the gutter and is rigidly attached to both the inner and outer edges of the gutter. The other strap is attached to the top of the cover and nailed to the top of the lower course of shingles. In another embodiment, the cover and gutter are formed of one piece of sheet metal. Water is prevented from reaching the inner edge of the gutter only by virtue of the fact that the cover is solidly attached to the cornice, or fascia, not to the roof, and by the fact that the lower course of shingles extends partway over the cover and gutter.

The cover and gutter in Cassens U.S. Pat. No. 891,405 are formed as a one-piece unit. The interlocking inner edges of both the cover and the gutter are attached to the cornice under, not over, the overhanging, outermost edge of the roof, and since the entire gutter structure is formed of a single sheet of metal, the cover could not be added to an existing gutter.

Goetz, U.S. Pat. No. 2,672,832, shows a separate cover sheet attached directly to the frame, or fascia, by a separate set of spikes. The inner edge of the cover has a V-shaped groove that fits a similar channel in the inner wall of the gutter to help hold the cover in place.

Foster, U.S. Pat. No. 3,388,555, shows another one-piece element that forms a combined gutter and cover. The inner edges of both the cover and gutter are separately attached to the eaves, or fascia, and, like the Cassens structure, the cover cannot be attached to a gutter that is already in place.

OBJECTS AND SUMMARY OF THE INVENTION

It is one of the objects of the present invention to provide an improved solid protective cover that can be separately installed on an existing gutter or can be installed simultaneously with the gutter.

Another object is to provide a solid, or impervious, protective gutter cover that has a flat inner edge extending under the outer edge of a course of roofing material and on top of an underlying section of the roof, and a curled outer edge that stops just short of the outer edge of the gutter.

According to the invention, a protective cover impervious to water has an outer, curled edge held in place so that it is spaced inwardly from the outer wall of the gutter to allow water to follow around the curled edge as a result of surface tension and to drain into the gutter by way of a space too narrow to admit any substantial debris. The holding means can be small clamps that engage spaced points of the curled edge and the lip of the gutter. Alternatively, if the gutter is held in place by spikes, the curled edge can rest on the spikes and can be held in place by straps that fit over the cover and under the lip of the gutter and under one of the lowest courses of shingles.

DETAILED DESCRIPTION OF THE INVENTION

Figure 1:
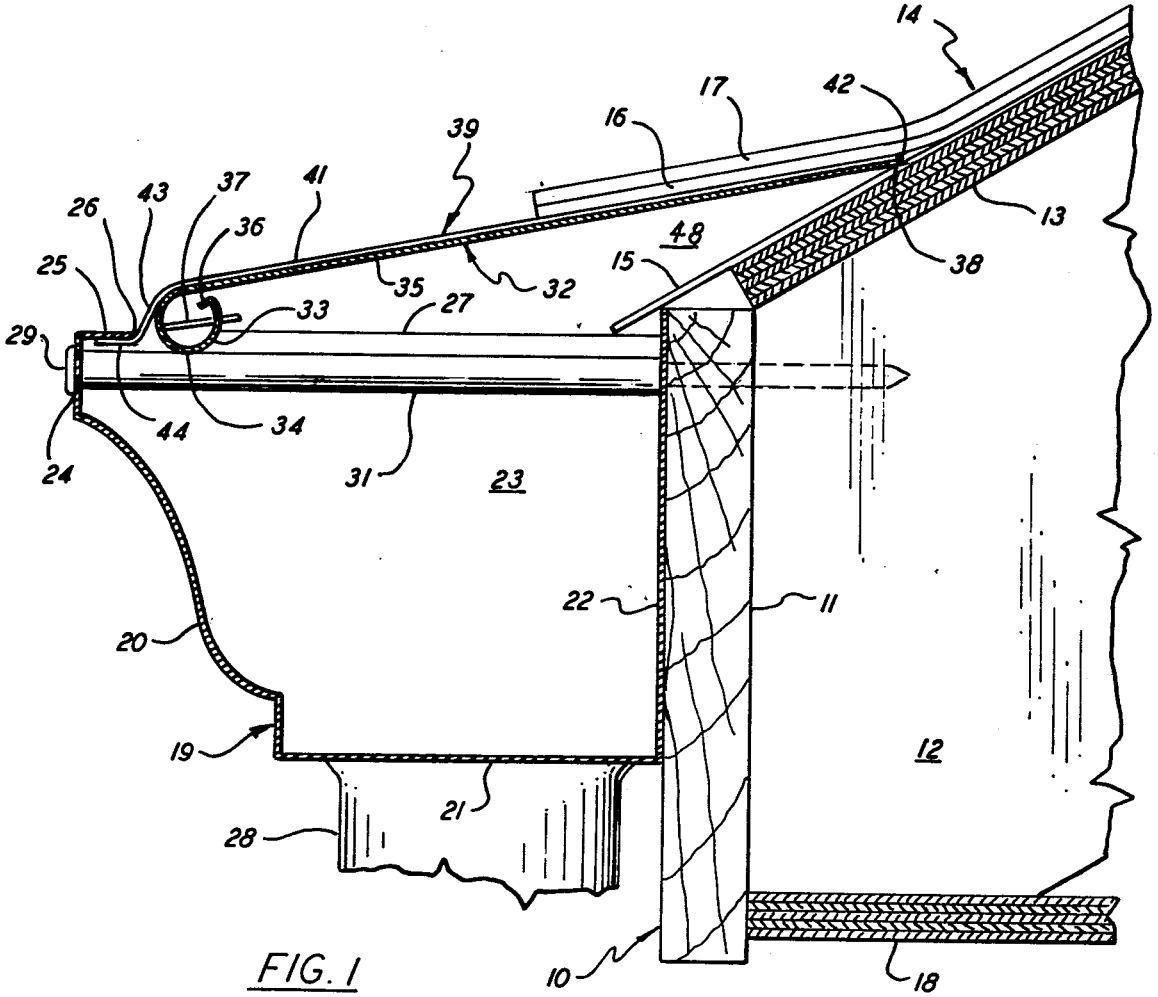
FIG. 1 is a partial cross-sectional view of the eave structure of a house, showing the protective device of the present invention.

FIG. 1 shows the eave structure of a building which is typically, but not necessarily, a house. This structure includes a fascia, or cornice 11, which is nailed to the ends of a series of rafters 12 that support the sheathing 13 that is a main structural member of the roof 14. The pitch of the roof may be as flat as 1 in 12, or even less, or as steep as 8 in 12, or even more. Such sheathing is typically made of about 0.9 cm or 1.2 cm plywood in current buildings. According to standard practice, the sheathing 13 is covered with a layer of roofing felt 15, typically of 15# weight, on which layers of shingles are nailed. The lower two layers of shingles 16 and 17 are the only ones shown. The underside of the eave structure is covered by a plywood soffit 18.

The gutter structure includes a gutter 19 having a front wall 20, a bottom wall 21, a rear wall 22, and end walls, of which only one end wall 23 is shown. Modern gutters of the type shown are referred to as O.G. gutters and are normally formed of galvanized sheet metal, aluminum or plastic. At the upper end of the front wall 20 is a vertical portion 24 and an inwardly turned lip 25 that has an innermost edge 26. This lip is at the same level as the upper edge 27 of the end wall 23. A downspout 28 leads water out of the gutter 19 and typically carries it to a drain or a drywell or simply out into the yard some distance from the building.

The gutter 19 is nailed to the fascia 11 by means of a series of spikes 29 that extend through holes in the vertical portion 24. In order to provide proper spacing, which is typically five or six inches, between the vertical portion 24 and the back wall 22 of the gutter structure, the spikes are enclosed in tubular metal ferrules 31.

The components described so far are of standard construction. Normally the lowermost edges of the lowest level of shingles 16 extend out over the lowermost edge of the roofing felt 15 so that water falling on the upper surface of the shingles runs directly into the gutter. While the water should run down the downspout 28, it has been found that it frequently carries twigs and leaves and other debris into the gutter 19 and either clogs up the downspout or builds up dams in the gutter 19 that prevent the proper runoff of water. In that case water tends to flow over the lip 25 of the gutter or even to back up into the building itself under the roofing felt 15.

Figure 2:
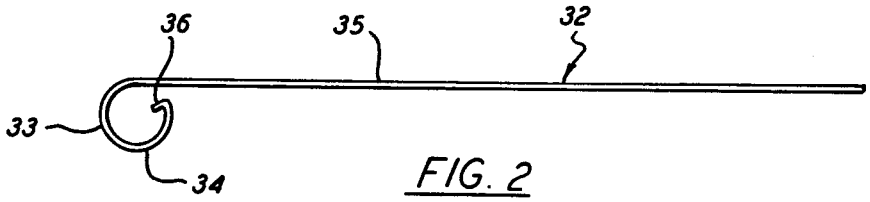
FIG. 2 is an end view of a gutter protective cover according to this invention.

In order to keep the gutter from accumulating debris, the present invention provides a cover 32, which is also shown separately in FIG. 2, in the form of an elongated sheet that extends longitudinally along the gutter 19 and is wide enough so that one edge can slide a substantial distance under the lower course of shingles 16. The other edge, which is bent into a curl 33, is located almost at the inwardly turned edge 26 of the lip 25. The cover is wider than the space between the edge 26 and the back wall 22 of the gutter. It is typically within a range of 14 cm to 20 cm wide and is preferably about 16.5 cm wide. It may be made of metal, such as aluminum or #26 gage galvanized iron, or it may be made of plastic. In the embodiment shown, the curl 33 has a diameter of about 1.2 cm and extends approximately 270° around a circle from the point at which it begins at the outer edge of the flat part 35 of the cover 32. The lowermost part of the curl identified by reference numeral 34 rests on the ferrules 31, and it would be sufficient if the curl extended only around to the point 34, which would be a curl of about 180°. However, the cover 32 is strengthened more if the curl completes a full 360°. In this embodiment, the edge 36 is turned sharply inward, and a connector 37, which will be described in greater detail in FIG. 5 helps position juxtaposed ends of two covers 32, if the covers are made shorter than the gutter 19.

In order to hold the cover 32 properly in place with respect to the roof 13 and the gutter 19, one edge 38 of the flat part 35 of the cover 32 is inserted under one or more courses of shingles, preferably the lowest course 16, and on top of the felt 15. The flat part 35 is wide enough so that the edge 38 can slide sufficiently far under the shingles to prevent any water from seeping under the shingles and getting the felt 15 wet. Since the cover 32 does not have to be nailed down, it can be easily inserted, even on a building already in use. It can also be easily removed to be installed in another location.

Figure 3:
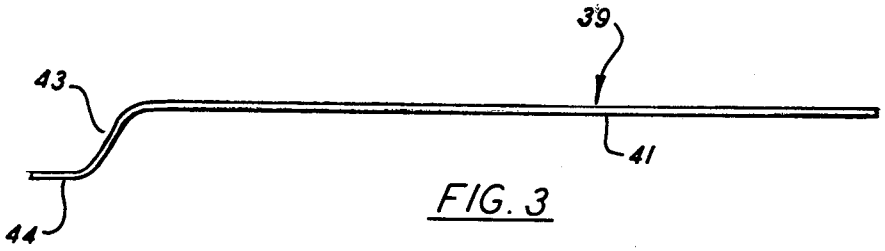
FIG. 3 is a side view of a strap to be used to hold down the cover in FIG. 2.
Figure 4:
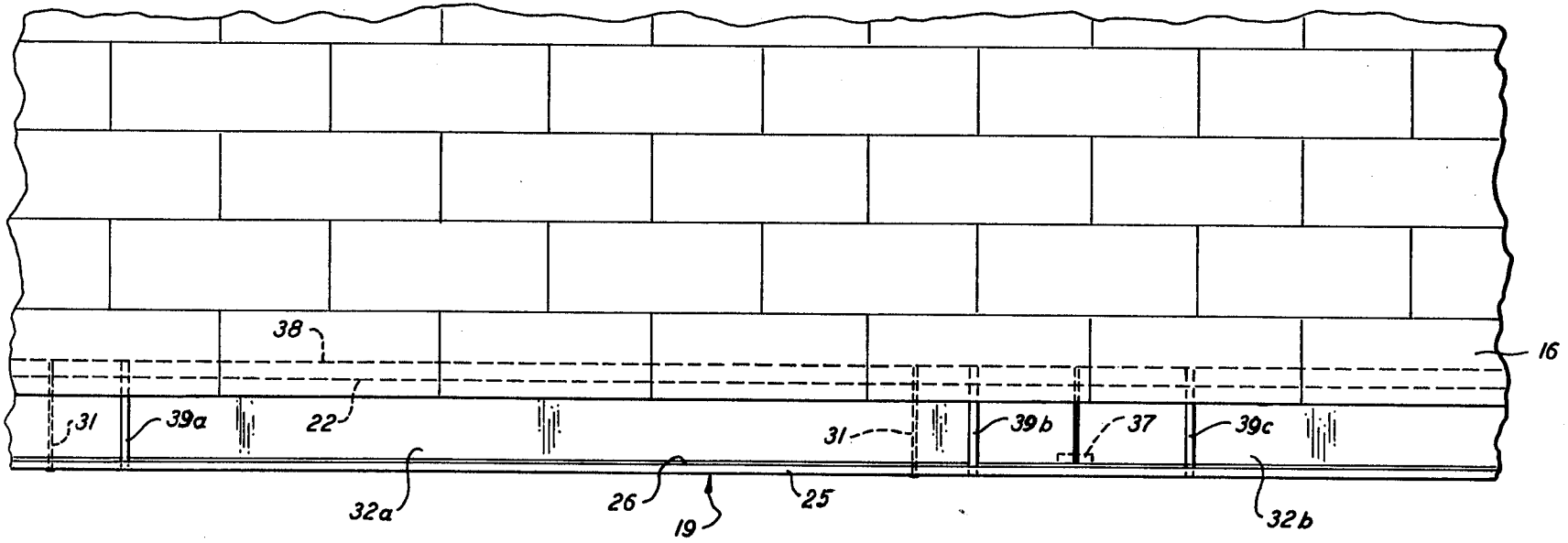
FIG. 4 is a fragmentary plan view of a roof showing the gutter and its protective cover as described in connection with FIG. 1.

The cover 32 is held in place without nails or other similar fasteners by one or, preferably, more straps 39, shown in FIGS. 1, 3 and 4. Each strap, which may be made of sufficiently rigid plastic or metal, such as, for example, #20 gage galvanized iron 1.2 cm wide, has a straight part 41, the length of which is approximately equal to the width of the cover 32 from the curl 33 to the edge 38 so that the strap 39 can fit flush against the upper surface of the cover 32 with the inner end 42 of the straight part 41 approximately coterminous with the edge 38 and with a downwardly extending portion 43 flush with the outer part of the curl 33 and terminating in an outwardly extending end 44 that slides under the inwardly turned lip 25. The straps 39 are thus firmly held in place, and they, in turn, hold the cover 32 firmly so as to leave a space of approximately 0.3 cm to 0.6 cm between the curl 33 and the edge 26 of the inwardly turned lip 25. This space is sufficient to allow water flowing down the upper surface of the shingles 16 and onto the upper surface of the covered section 32 to follow the curl 33 by surface tension and to fall into the gutter 19, even if the water results from a heavy downpour.

FIG. 4 shows a section of a roof with the gutter 19 along one edge. The reference numerals used in FIG. 4 are the same as those used in FIGS. 1–3. The cover 32 may be made as long as necessary, and can either be preformed, for example of plastic or sheet metal, such as aluminum or galvanized steel, or it may be made by on-the-job mechanism similar to that used in forming some gutters out of flat sheet aluminum. However, it is convenient to make the cover 32 in standardized shorter lengths. Cover sections about 1.5 m long have been found to be quite satisfactory. Thus, in FIG. 4 there are portions of two covers 32*a* and 32*b*. The cover portion 32*a* is held in place by two straps 38*a* and 38*b*. One of the connectors 37 holds the ends of the cover sections 32*a* and 32*b* in alignment.

FIG. 4 also shows that most of the open space of the gutter 19 is covered by the covers 32*a* and 32*b*. The small, remaining slot between the lip 25 and the adjacent edge of the covers 32*a* and 32*b* is less than 10% of the normal open area. The covers 32*a* and 32*b* extend over at least about 90% of the normally open area and preferably over about 97%.

Figure 5:
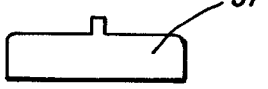
FIG. 5 is an enlarged plan view of a connector used in the structure in FIGS. 1 and 4.

FIG. 5 shows one of the connectors 37 as having a small tab about 0.3 cm wide about 0.3 cm from one edge to provide a small space between adjacent ends of the cover sections 32*a* and 32*b*. While the connector 37 is handy to hold adjacent ends of two cover sections 32*a* and 32*b* in alignment, other connecting means may be used.

Figures 6, 7:
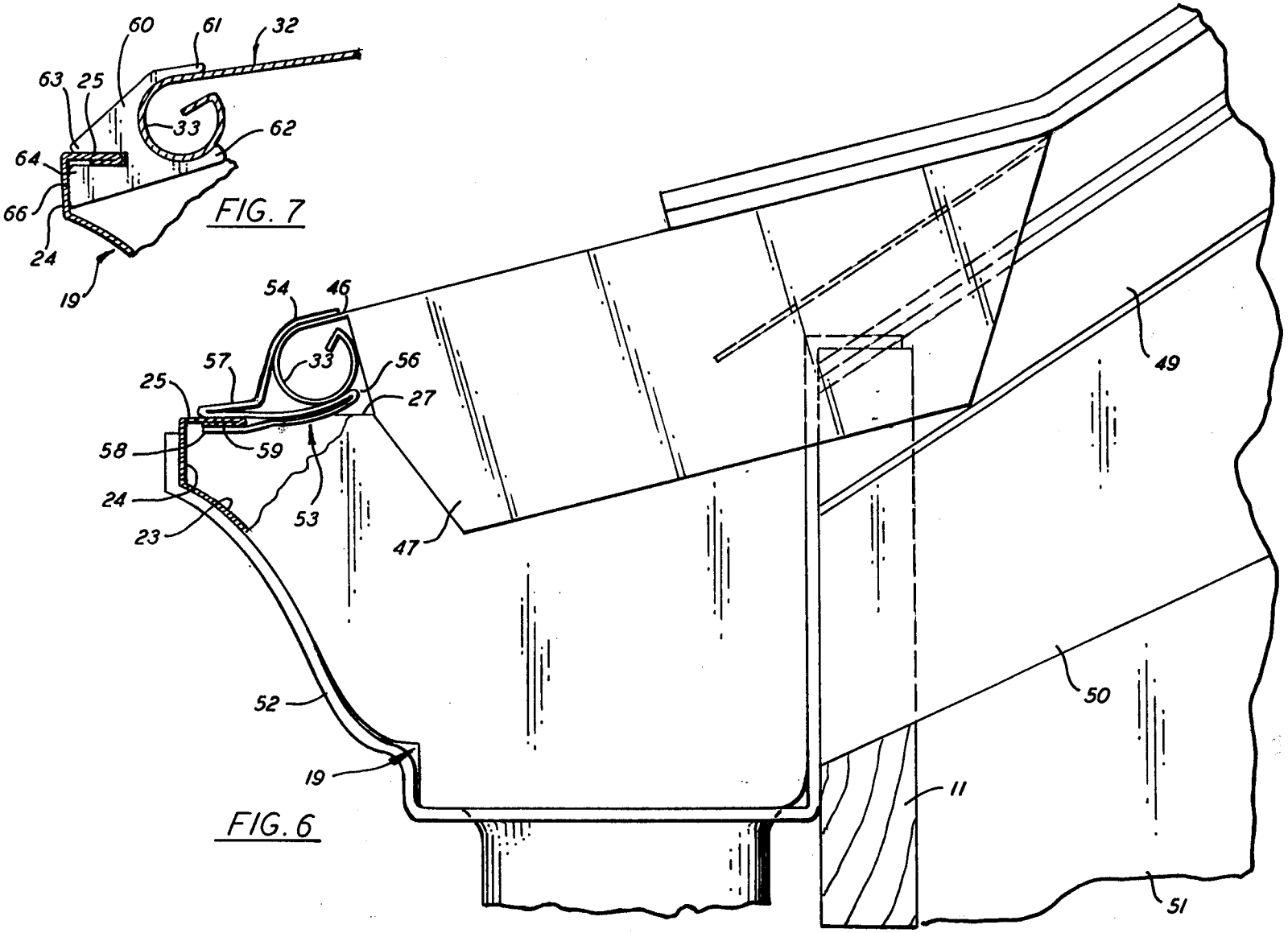
FIG. 6 shows a fragment of the eave structure of a house and a modified embodiment of the invention.
FIG. 7 shows a modified clip suitable for use in holding a protective cover in place.

FIG. 6 shows a modified cover 46 generally similar to the cover 32 of FIG. 1 except that it has a flap 47 bent downwardly at the end. This flap covers a triangular opening (indicated by reference number 48 in FIG. 1) that would be large enough to admit birds into the space under the cover 32 in FIG. 1. The opening cbuld also admit some rain and some of the debris that the cover is intended to keep out. The flap 47 at each end of the gutter extends down far enough to overlap the end of a rake molding 49 and perhaps part of a rake board 50 that covers the upper edge of the siding 51. The flap 47 could be formed as an L-shaped separate member or each flap could be made at one end of some of the standard cover members at the same time the curl 33 was formed. Alternatively, the curl 33 could be formed to the end of a cover member 46 and then a part of the cover member, including the end of the curl 33, could be cut away to leave a flat part of the member 46 that could then be bent down to form the flap 47.

The embodiment in FIG. 6 shows a different, standard support 52 to hold the gutter in place on the fascia 11. The generally U-shaped support 52 is formed to fit around the outside of the gutter 19 to replace the spikes 29 in FIG. 1. Without spikes to rest on, the curl 33 would droop into the gutter but, in accordance with one of the spacing means of this invention, is prevented from doing so by clips 53 spaced along the cover 46 in the same way that the straps 39*a*–39*c* in FIG. 4 are spaced along the cover 32.

Each of the clips 53 is about 1 cm to 2 cm long as measured in the longitudinal direction of the gutter 19 and is formed so that it has a first pair of jaws 54 and 56 shaped to grasp the curl 33 and a second pair of jaws 57 and 58 to grasp the inwardly turned lip 25 with the reverse-bent edge 59. The jaws 54, 56 and 57, 58 face in opposite directions and, in this embodiment, are formed of a single strip of sheet metal. The respective pairs of jaws are spaced from each other so that they hold the curl 33 and the inwardly turned lip 25 the same distance apart as the strap 39 in FIG. 1 does. Furthermore, they grasp the curl and the lip tightly enough to prevent the outer edge of the cover 46 on which the curl is formed from drooping into the gutter 19.

FIG. 7 shows a modified embodiment 60 of the clip 53 of FIG. 6. The clip 60 can be extruded or molded or stamped out of sufficiently rigid stock. In this embodiment, it is stamped out of sufficiently rigid metal or plastic, such as, for example, a sheet of rigid aluminum alloy about 0.3 cm thick, although it may be desirable to make it thicker or thinner. The clip 60 is shown as having a pair of jaws 61 and 62 that engage the curl 33 and preferably have a matching curvature. The opposite edge of the clip 60 engages the outer part of the gutter 19 to maintain the required spacing between the curl 33 and the gutter, and it is convenient for that edge of the clip to have another pair of jaws 63 and 64 to fit the edge part of the gutter 19. In this embodiment, the jaws 63 and 64 fit over the inwardly turned lip 25, and the lower jaw has an outer end 66 that substantially conforms to the inwardly facing surface of the vertical portion 24 of the gutter 19. The fact that the lower corner of the jaw 64 engages the portion 24 relatively far from the inwardly turned lip 25 stabilizes the clip 60 and prevents it from rotating counterclockwise (as seen in FIG. 7) in response to downward pressure of the cover 32. In fact, the clip 60 holds the covers 32*a* and 32*b* in FIG. 4 in place so well that connectors 37 between proximal ends may be eliminated.

What is claimed is:

1. A protective structure for installation over a gutter structure attached to a building having a sloping roof comprising sheathing and roofing material over the sheathing, the gutter structure comprising an elongated gutter having a generally U-shaped cross-section including upwardly extending inner and outer sides and being attached to the building adjacent to and slightly lower than the lower edge of the roof to receive water run-off therefrom, the protective structure comprising:

a cover comprising an elongated, solid sheet having two parallel longitudinal edges, one of the longitudinal edges extending under at least a lower edge of the roofing material, the other one of the longitudinal edges formed with a curl, the cover extending downwardly and outwardly from the lowermost edge of the roof, with the curl extending downward toward the gutter, and the cover extending over at least approximately 90% of the open width of the gutter but with the edge containing the curl spaced from the outer side of the gutter by a distance of at least approximately 0.3 cm; and a plurality of spacer members disposable at a distance from one another along the outer edge of the sheet, each of the spacer members comprising engaging means for controlling the spacing between the outer edge of the sheet and the outer side of the gutter, the engaging means including a first part curved to fit at least partially around the curl at the other edge of the sheet and a second part shaped to engage the outer side of the gutter, the first part of the engaging means being spaced, in a direction toward the inner side of the gutter, from the second part by a distance determined at least partially by the desired distance between the outer edge of the sheet and the outer side of the gutter, whereby said spacer members will space said curl from the outer side of the gutter by said distance of at least approximately 0.3 cm, thereby permitting water to flow around said curl through said space and into said gutter, said cover preventing debris from entering said gutter and causing clogging thereof.

2. The invention as defined in claim 1 in which the upwardly extending outer side of the gutter comprises an inwardly extending lip, and the second part of the engaging means comprises an outwardly extending end portion adjacent the curved means but directed oppositely therefrom to extend under the inwardly extending lip to hold the respective spacer member in place.

3. The invention as defined in claim 2 in which the spacer members each comprise a central portion and the first part and the second part of the engaging means respectively comprise a first clip and a second clip extending from the central portion, the second clip engaging the edge of the outer side of the gutter and the first clip engaging the curl of the cover to hold the outer side of the gutter and the curl in substantially fixed, spaced relationship.

4. The invention as defined in claim 3 in which each of the first clips comprises a pair of jaws to engage the curl.

5. The invention as defined in claim 4 in which each of the second clips comprises a pair of jaws to engage the lip of the gutter.

6. The invention as defined in claim 5 in which the second pair of jaws are closer together at a region adjacent their outer ends than at a region closer to the central portion of the respective clip.

7. The invention as defined in claim 2 in which the gutter structure comprises a plurality of spikes extending through the outer side of the gutter near the inwardly extending lip thereof and the spacer members comprise straps long enough to extend over the top of the cover, one end of each strap engaging the outer side of the gutter and the other end extending under the edge of the roofing material to hold the curl down against the spikes.

8. The invention as defined in claim 7 in which the curved means of the spacer straps is a curved portion adjacent one end of each of the straps and the remainder of the straps between the curved portion and the other end conforms substantially to the surface of the cover between the longitudinal edges thereof.

9. The invention as defined in claim 8 in which the length of the remainder of the straps from the curved portion to the other end is substantially equal to the width of the cover from the one longitudinal edge thereof to the other longitudinal edge.

10. The invention as defined in claim 1 in which the elongated sheet is curled in a substantially cylindrically-shaped curl around at least approximately 180°.

11. The invention as defined in claim 10 in which the cylindrically shaped curl extends around at least substantially 270°.

12. The invention as defined in claim 11 in which the cylindrically shaped curl terminates in an inwardly directed edge portion.

13. The invention as defined in claim 11 in which the protective structure comprises:

a plurality of the elongated sheets arranged substantially end to end; and a connector connecting the proximal ends of adjacent sheets together, the connector comprising a pair of substantially parallel opposite edges spaced apart by a distance substantially equal to the inner diameter of the curled portion of the plates, at least one of the edges comprising an outwardly extending tab midway along its length to engage end edge portions of the adjacent sheets to prevent the connector from being pushed entirely into either of the adjacent curls.

14. The invention as defined in claim 1 comprising a flap extending substantially perpendicularly from at least one end of the cover.

15. The invention as defined in claim 13 in which the flap is the endmost part of the cover bent perpendicularly to the remainder of the cover.

* * * * *